US005373798A

United States Patent [19]

Price et al.

[11] Patent Number: 5,373,798

[45] Date of Patent: Dec. 20, 1994

[54] CLOTH CUTTER ATTACHMENT

[75] Inventors: Elvin C. Price, Dacula; Preston B. Dasher, Lawrenceville, both of Ga.

[73] Assignee: Atlanta Attachment Company, Lawrenceville, Ga.

[21] Appl. No.: 188,603

[22] Filed: Jan. 27, 1994

Related U.S. Application Data

[63] Continuation of Ser. No. 958,072, Oct. 7, 1994, abandoned.

[51] Int. Cl.[5] ..... D05B 3/06

[52] U.S. Cl. ..... 112/264.1; 112/68

[58] Field of Search ..... 112/262.1, 264.1, 65, 112/66, 68, 122, 128, 129, 125, 257, 122.1, 217.1

[56] References Cited

U.S. PATENT DOCUMENTS

| | | | |
|---|---|---|---|
| 2,573,359 | 10/1951 | Rich | 112/65 |
| 2,581,046 | 1/1952 | Rich | 112/68 |
| 2,619,926 | 12/1952 | Holden | 112/270 |
| 2,620,759 | 12/1952 | Pantusco et al. | 112/68 |
| 2,657,657 | 11/1953 | Fuhse | 112/270 |
| 3,361,098 | 1/1968 | Seaman | 112/125 |
| 3,440,982 | 4/1969 | Seaman | 112/68 |
| 3,747,545 | 4/1972 | Niclay | 112/68 |
| 4,271,768 | 6/1981 | Goldbeck et al. | 112/68 |
| 4,934,010 | 6/1990 | Tarlton | 112/257 X |
| 5,085,157 | 2/1992 | Jung et al. | 112/68 |
| 5,085,158 | 2/1992 | Goldbeck et al. | 112/68 X |

FOREIGN PATENT DOCUMENTS

| | | | |
|---|---|---|---|
| 2106800 | 5/1987 | Japan | 112/257 |
| 0666295 | 7/1988 | Switzerland | 112/257 |

OTHER PUBLICATIONS

Reece Series 42 Welting Machine Service Manual, 1974, The Reece Corp., pp. 5 and 7.

*Primary Examiner*—Clifford D. Crowder
*Assistant Examiner*—Larry D. Worrell, Jr.
*Attorney, Agent, or Firm*—Hopkins & Thomas

[57] ABSTRACT

A cloth cutter attachment (12) mounted onto a conventional double sewing machine (10) for shifting a cutter blade assembly (17) past the needle mount assembly (15) of the sewing machine so that the cutter blade of the cutter blade assembly shifts between and ahead of and behind the double needles of the sewing machine. The cloth cutter attachment allows a cut to be made in a cloth material between the two rows of stitches sewn by the double needles. Such a stitch and cut operation is desirable for forming a set-in pocket.

4 Claims, 6 Drawing Sheets

CLOTH CUTTER ATTACHMENT

This is a continuation of copending application Ser. No. 07/958,072 filed on Oct. 7, 1994, now abandoned.

FIELD OF THE INVENTION

This invention pertains to an attachment for a double needle sewing machine which includes a pair of side-by-side sewing needles and a cloth cutter positioned between the needles. More particularly, the invention comprises an attachment that includes sewing needles and a cutter blade assembly movable to positions ahead of and behind the sewing needles in order to cut between the stitching at positions ahead of or behind the stitches as they are being formed by the needles.

BACKGROUND OF THE INVENTION

In the manufacture of various types of garments, it is sometimes desirable to provide a pocket at a location on the garment where no seam exists. Such a pocket is commonly referred to as a "set-in" pocket. For example, in the manufacture of tubular knit pants, a seam is created down the front and back of the pants, but the sides of the pants, where pockets are typically provided, are seamless. Other types of garments requiring a set-in pocket may be hooded sweat shirts, sweat pants, placket front shirts, and slacks.

One method for sewing a pocket at a seamless position on a garment is to overlay a pocket piece of material onto the garment material, sew two parallel rows of stitches through both of the materials, and cut the two overlying materials between the two rows of stitches. The resulting stitched and cut overlying materials can then be formed into a pocket with a few additional sewing operations.

In the past, the cutting step of such a method was typically a manual operation, and as a result usually required the production of low-cost garments with set-in pockets to be carried out in third world countries where labor is cheap. However, cloth cutting attachments for double needle sewing machines have been devised that, in conjunction with the sewing needles, automatically stitch and cut the overlying pieces between the lines of stitching in one operation.

The cloth cutter attachment includes a cutter blade that is carried on the reciprocating needle bar of the sewing machine and is movable so as to first cut the cloth ahead of the stitches being formed at the beginning of the lines of stitching and later is moved to cut the cloth behind the stitches being formed at the ends of the lines of stitching. The cloth cutter attachment also includes a non-reciprocating lever for changing the position of the cutter. As a result, the manufacture of the rather complex movable cutter that must move with the sewing needles and also must shift to be ahead of and behind the needles was heavy and expensive and the operation of the system was relatively slow. Therefore, the garments on which the prior art devices are used usually are relatively expensive.

The provision of an actuator means, which rides on the reciprocating needle bar mount to shift the cutter blade, was later developed and was determined to create control problems due to vibrations caused by the high rate of reciprocation of the needle bar.

SUMMARY OF THE INVENTION

Briefly described, the present invention comprises a cloth cutter attachment for a double needle sewing machine, which, in conjunction with the double needles of the sewing machine, sews two parallel lines of stitches while cutting the sewn fabric between the two lines. To reduce the number of stitching operations necessary for ultimately producing the pocket, it is desirable for the lines of stitching to be of greater length than the cut portion of the material. This allows the ends of the pocket to be bar tacked with a simple stitching operation to provide stitching completely around the pocket.

To create a cut portion of the material that is shorter in length than the lines of stitching, it is necessary to move the cutter blade with respect to the double needles. The present invention accomplishes this by providing a needle mount assembly, which is mounted on the needle bar and which supports the sewing needles, and a cutter blade assembly. The cutter blade assembly is slidably mounted within the needle chuck of the needle mount assembly with a cutter blade extending downwardly from the needle mount between the double needles. An actuator means is mounted to the sewing machine frame for intermittently engaging the cutter blade assembly to shift the cutter blade assembly forward and backward between the double needles in a controlled manner to produce the desired stitch and cut operation.

The cutter blade assembly includes a slide bar that is closely received within a slide channel of the needle chuck between the double needles. The cutter blade of the cutter blade assembly depends from the slide bar and moves through a slot extending fore and aft of the needles along the bottom of the needle chuck. The mounting of the cutter blade assembly between the double needles and in a close fit manner within the needle chuck provides good balance and fit for the cutter blade assembly, thereby ensuring proper cutter blade alignment.

The slide bar of the cutter blade assembly has a headed end that protrudes beyond one end of the needle chuck with a cross bar mounted transversely thereon. The headed end of the slide bar and the cross bar cooperate with the actuator means to shift the cutter blade assembly back and forth.

The actuator means comprises a cutter blade retracting linkage having a cam lever that is pivotally mounted to the sewing machine frame. The cam lever is adapted to engage the headed end of the cutter blade assembly extending beyond the needle chuck as the needle mount assembly reciprocates and as the two lines of stitching are sewn. The engagement of the cam lever with the headed end of the cutter blade assembly retracts the cutter blade assembly through the needle chuck in order to reposition the cutter blade from a position ahead of the sewing needles to a position behind the sewing needles, relative to the advancement of the fabric material toward the needles.

The actuator means also includes a cutter blade advancing linkage that is pivotally mounted to the sewing machine frame above the needle chuck. The advancing linkage includes a pair of prongs that depend from the forward end of the linkage and straddle the needle chuck and cutter blade assembly. When the advancing linkage is pivoted forward, the prongs depending therefrom engage the cross bar mounted to the headed end of the cutter blade assembly slide bar and advance the cutter blade assembly so that the cutter blade is repositioned forwardly of the sewing needles. The pair of prongs that depend from the advancing linkage straddle the cutter blade assembly as they engage the cross bar, and thus reduce any lateral forces on the cutter blade assembly.

Within the needle chuck, a spring loaded ball and detent means is provided that includes a spring loaded ball, which is adapted to engage either of two detents, a forward detent and a rearward detent, within the slide bar of the cutter blade assembly. The engagement of the ball with the forward or rearward detents stops longitudinal movement of the cutter blade assembly and yieldably holds it in its forward or rearward positions, respectively, once the cutter blade assembly has been shifted by the actuator means.

The cutter blade assembly, comprising the slide bar with its headed end and the cross bar mounted transversely thereto, as well as the cutter blade depending from the slide bar, is an integral unit. By mounting the operable parts of the actuator means to the sewing machine frame, rather than the needle mount assembly itself, the number and weight of parts that are carried by the needle mount assembly are reduced to the integral cutter blade assembly. Thus, as the needle mount assembly reciprocates it carries less weight and the actuator means is subject to less vibration and, therefore, can precisely control the repositioning of the cutter blade assembly.

In addition, the cutter blade retracting linkage for shifting the cutter blade assembly to its rearward position is intermittently engageable with the cutter blade assembly so that once the cam lever of the retracting linkage has shifted the cutter blade assembly to its rearward position, the spring loaded ball of the ball and detent means within the needle chuck engages the rearward detent in the slide bar and holds the cutter blade assembly in the rearward position, after the cam lever disengages from the headed end of the cutter blade assembly. Thus, the cam lever of the actuator means is not continuously engaged with the cutter blade assembly as the cutter blade assembly is held in its rearward position by the ball and detent system, which reduces wear and tear between the two elements.

The sewing machine also includes a cutter blade mounting block upon which the cutter blade assembly can be temporarily mounted by an operator to replace a broken or worn out cutter blade. The cutter blade assembly is easily removable from the needle chuck and can be mounted onto the mounting block to brace the cutter blade assembly as the operator changes out the cutter blade.

In addition, the controls for the cloth cutter attachment include an adapter cable that is easily connected to the sewing machine control box and the solenoid cable leading to the sewing machine, thereby providing a simple means for integrating the cloth cutter attachment controls with the sewing machine controls.

Thus, it is an object of the invention to provide an improved cloth cutter attachment for a double needle sewing machine that has a cloth cutter which can be moved longitudinally between the sewing needles to cut the cloth ahead of or behind the stitches being formed by the needles.

Another object of the invention is to provide an improved apparatus for forming a set-in pocket for a garment that includes a movable cloth cutter blade for mounting on the needle bar of the sewing machine and a shifting actuator that is mounted to the sewing machine frame rather than the reciprocating needle bar for moving the cloth cutter.

Another object of the present invention is to provide an improved apparatus for forming a set-in pocket that has minimum of parts that are mounted to the needle bar of the sewing machine.

Another object of the present invention is to provide an improved cloth cutter attachment for mounting to the needle bar of a sewing machine which includes a cutter blade extending downwardly toward the work product and with the cutter blade being movable during the sewing function to positions ahead of and behind the positions where the stitches are being formed in the work product.

Another object of the present invention is to provide an improved cloth cutter attachment for forming a set-in pocket in a garment that reduces wear and tear and vibrations between operable parts of the movable cutter blade and its actuator.

Another object of the present invention is to provide an improved cloth cutter attachment for forming a set-in pocket that minimizes the weight of the reciprocating needle mount assembly and cutter blade assembly while retaining structural strength and reliability.

Another object of the present invention is to provide an improved cloth cutter attachment for a sewing machine that is easily installed on existing sewing machines with a minimum of expense.

Another object of the present invention is to provide a method and apparatus for forming a set-in pocket that is simple in design and operates rapidly and efficiently to produce the desired stitch and cut operation.

Other objects, features, and advantages of the present invention will become apparent from the following specification, when read in conjunction with the accompanying drawings.

DETAILED DESCRIPTION

Figure 1:
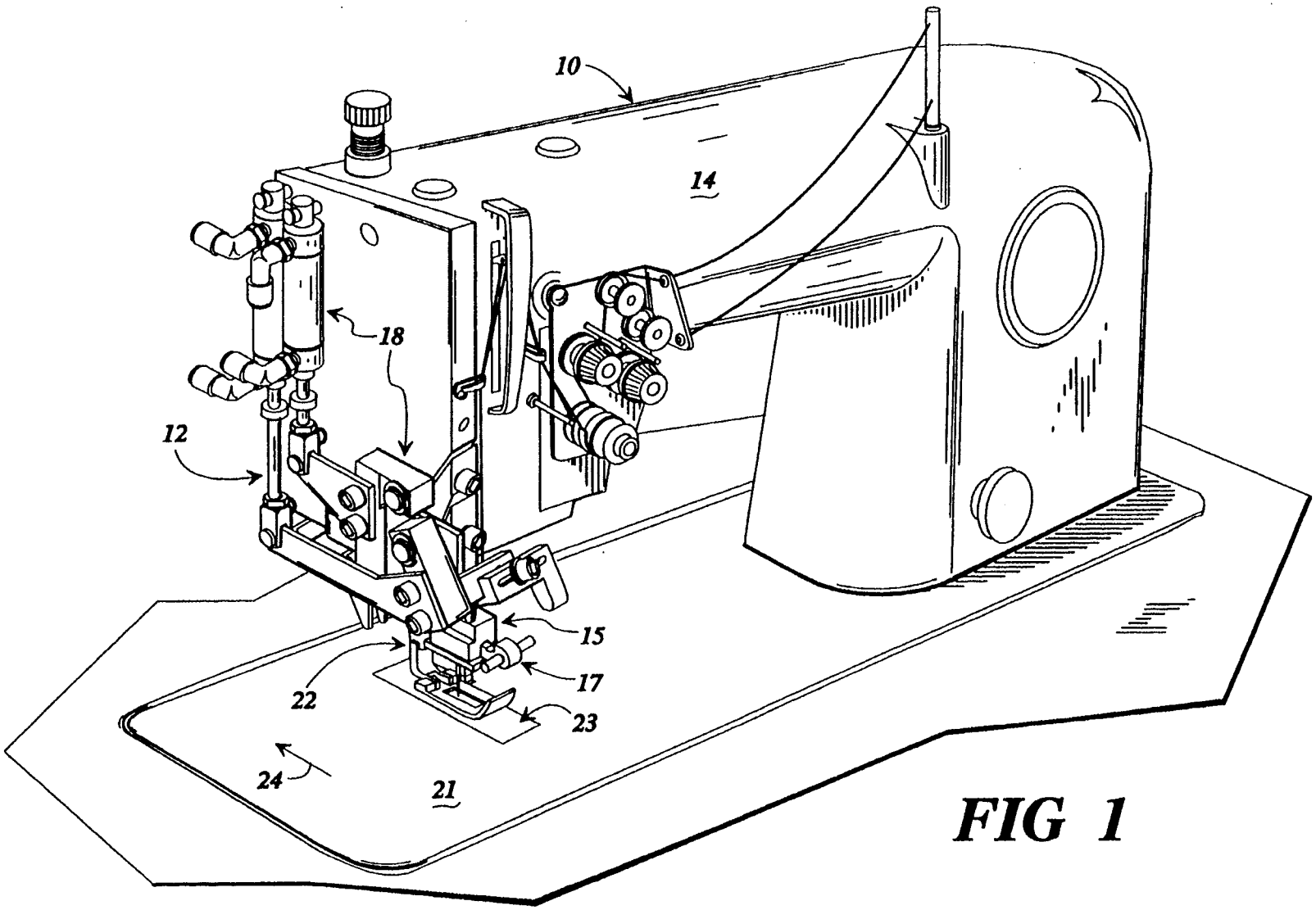
FIG. 1 is a perspective view of a conventional sewing machine with the cloth cutter attachment constructed in accordance with a preferred embodiment of the present invention attached thereto.

Referring now in more detail to the drawings, in which like numerals represent like parts throughout the several views, FIG. 1 illustrates a conventional sewing machine 10 with the cloth cutter attachment 12 mounted to the end of the housing frame 14 of the sewing machine 10. The cloth cutter attachment 12 comprises, generally, a needle mount assembly 15, a cutter blade assembly 17 and an actuator means 18. The sewing machine 10 includes a work surface 21, a presser foot assembly 22 for securing the cloth to be stitched and cut, a throat plate 23 with feed dogs (not shown) mounted below and movable up through the throat plate for advancing the cloth in the direction indicated by arrow 24.

Figure 2:
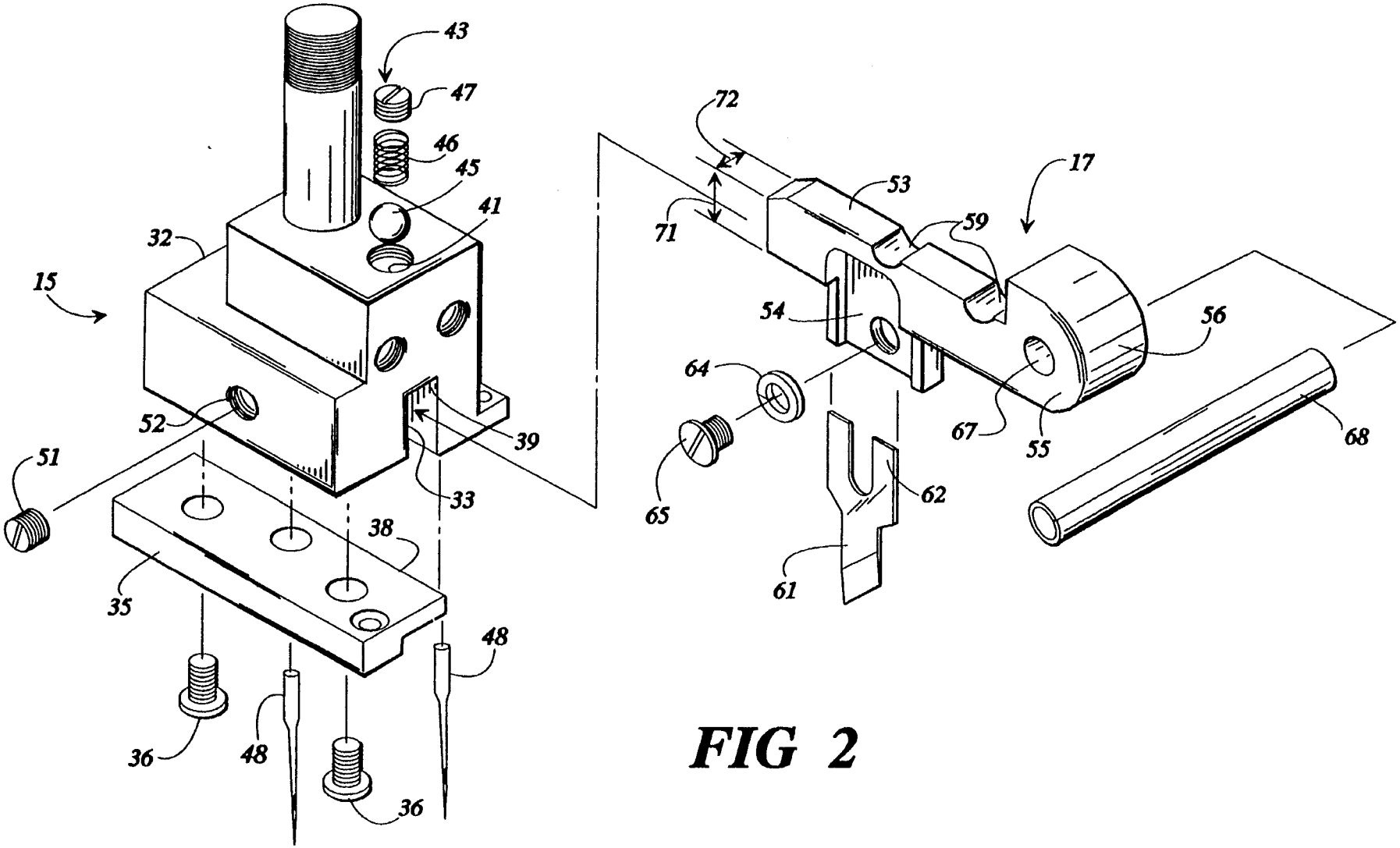
FIG. 2 is an enlarged exploded detailed view of the needle mount assembly and its cutter blade assembly shown in FIG. 1.

FIG. 2 is an enlarged detailed view of the needle mount assembly 15 and the cutter blade assembly 17. The needle mount assembly 15 is mounted on the needle bar that is reciprocated by the sewing machine and the needle (not shown) mount assembly includes a needle chuck 32. The needle chuck 32 is an irregular shaped block that has a slide channel 33 formed therein that extends the length of the needle chuck 32. An elongated gib 35 is secured to the underside of the needle chuck 32 by screws 36. The interior edge 38 of the gib 35 is spaced from the interior wall 39 of the slide channel 33 in order to form a slot extending fore and aft along the length of the needle chuck 32 below the slide channel 33. The slot allows the cutter blade assembly 17 to slide within the slide channel 33 with its cutter blade extending downwardly from the needle chuck 32 through the slot toward the pocket material. The needle chuck 32 also includes a partially threaded bore 41 extending from the topside of the needle chuck 32 downwardly to intersect the slide channel 33. A ball and detent means 43 is provided within the bore 41 and includes a ball 45, a spring 46 and a set screw 47 which are carried by the chuck 32. The spring 46 urges the ball into engagement with the cutter blade assembly 17.

A pair of needles 48 are secured within bores (not shown) in the underside of the needle chuck 32. A set screw 51 and threaded set screw opening 52 also are provided at each side of the needle chuck 32 for securing the needles 48 to the needle chuck 32.

The cutter blade assembly 17 includes a slide bar 53 having a cutter blade holding plate 54 depending therefrom and a headed end 55 that includes a curved surface 56 that functions as a cam follower means for engaging a cam lever of the actuator means, as discussed hereinafter. The slide bar 53 further includes a pair of curved notches or detents 59 along its top edge adapted to receive closely and mate with the spring loaded ball 45 of the detent means 43. A cutter blade 61 having a yoke 62 is secured to the cutter blade holding plate 54 by a washer 64 and a head screw 65. The headed end 55 of the slide bar 53 has a transverse bore 66 therein for receiving a cross bar 68 in the form of an elongated spring pin.

The height 71 and width 72 of the slide bar 53 are of dimensions that allow the cutter blade assembly 17 to move slidably fore and aft within the slide channel 33 of the needle mount assembly 15 and above the gib 35. The slot formed between the interior edge 38 of the gib 35 and the interior wall 39 of the slide channel 33 allows the cutter blade holding plate 54 and the cutter blade 61 to extend downwardly from the needle chuck 32 as the cutter blade assembly 17 slides within the needle chuck 32.

Figure 3:
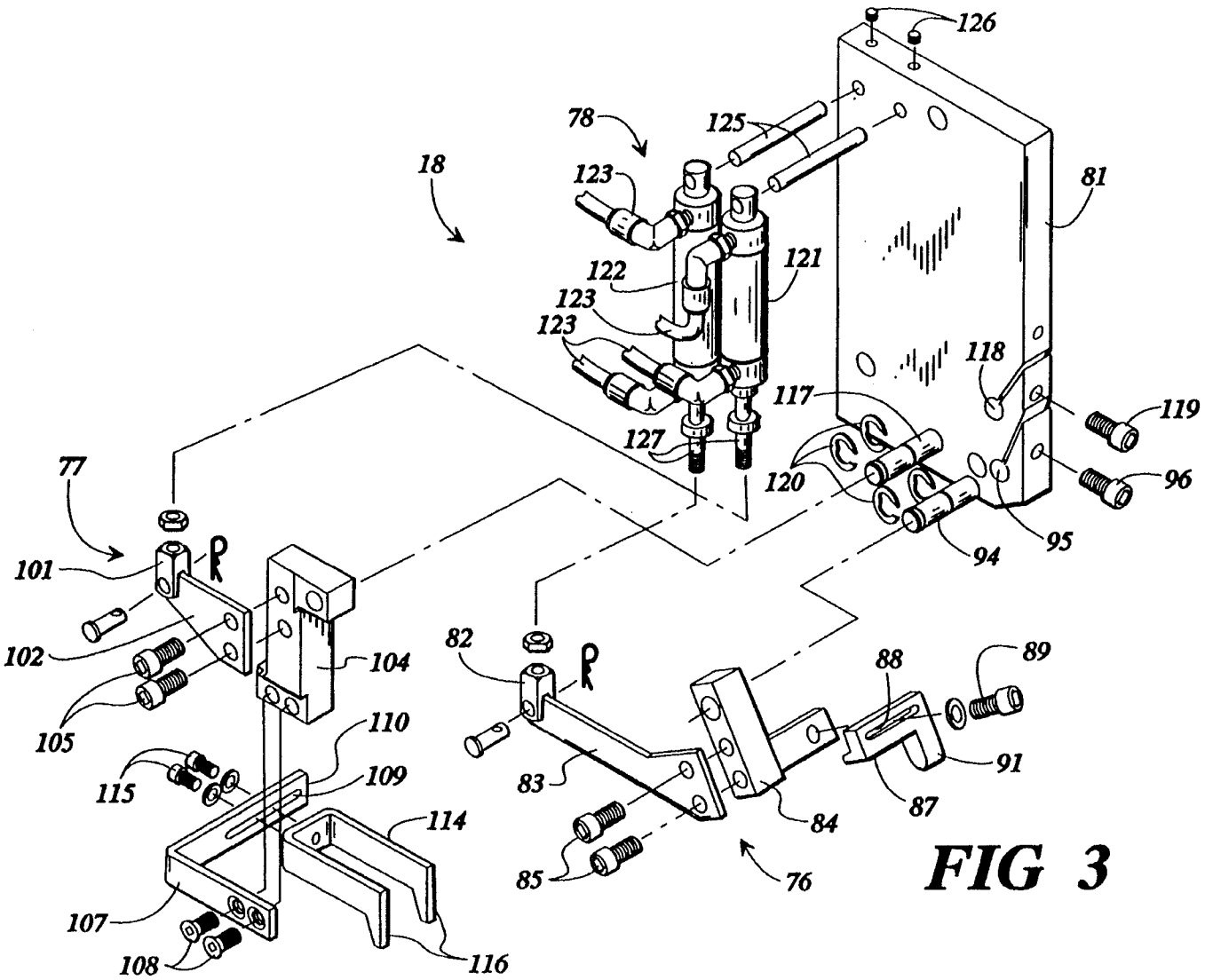
FIG. 3 is an enlarged exploded detailed view of the actuator means of the cloth cutter attachment shown in FIG. 1.

FIG. 3 is an exploded view of the actuator means 18. The actuator means 18 comprises, generally, a cutter blade retracting linkage 76 for shifting the cutter blade assembly rearwardly behind the sewing needles with respect to the on coming work product, an advancing linkage 77 for shifting the cutter blade assembly forwardly ahead of the sewing needles with respect to the on coming work product, and a pair of air cylinders 78 for moving the two linkages 76, 77. A flat face plate 81 is provided for supporting the cutter blade retracting linkage 76, the advancing linkage 77, and the pair of air cylinders 78. The face plate 81 is mounted to the sewing machine housing frame.

The cutter blade retracting linkage 76 comprises a clevis 82 that is pivotally secured to an indexer lever 83. An L-shaped indexer pivot 84 is secured to the indexer lever 83 by a pair of cap screws 85. An indexer slide 87 having a slot 88 is secured to the indexer pivot 84 by a cap screw 89. The indexer slide 87 includes a thumb lever 91 having on its underside a cam surface 92, which is engageable with the curved surface 56 of the headed end 55 of the slide bar 53, discussed previously with reference to FIG. 2. The indexer slide 87 including its thumb lever 91 shall be referred to as a cam lever hereinafter. The cam lever is secured to the face plate 81 by a pivot pin 94 receivable in a hole 95 within the face plate 81 and held therein by a cap screw 96.

The advancing linkage 77 comprises a clevis 101 pivotally secured to an indexer lever 102. An indexer arm 104 is secured to the indexing lever 102 by a pair of cap screws 105. An L-shaped indexer finger bracket 107 is secured to the bottom of the indexer arm 104 by a pair of cap screws 108. A slot 109 is formed along the rear leg 110 of the L-shaped indexer finger bracket 107. A U-shaped indexer finger 114 is secured to the indexer finger bracket 107 by a pair of cap screws 115. The U-shaped indexer finger 114 includes a pair of downwardly projecting prongs 116 that are adapted to engage the spring pin 68 mounted transversely in the head 55 of the slide bar 53. The advancing linkage 77 is secured to the face plate 81 through the indexer arm 104 via a pivot pin 117 secured in hole 118 by a cap screw 119. E rings 120 are provided to hold-the pivot pins 94, 117 in place.

The air cylinders 78 include a front air cylinder 121 and a rear air cylinder 122. The front and rear cylinders 121, 122 have pneumatic connections 123 that lead to the controls for the actuator means 18. The front and rear air cylinders are mounted to the face plate 81 by dowel pins 125 secured by set screws 126. A piston rod 127 extends from the lower end of each air cylinder 121, 122 and has a threaded end for securing to it the clevises 82, 101 of the cutter blade retracting linkage 76 and the advancing linkage 77, respectively.

Figure 4:
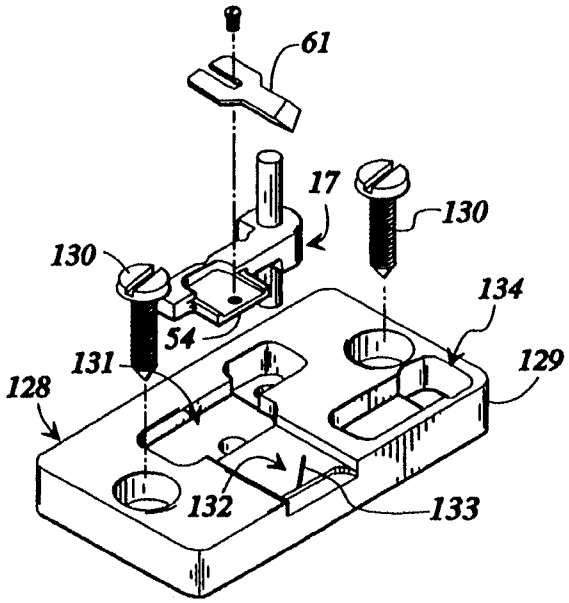
FIG. 4 is a detailed perspective view of the cutter blade installation jig for changing out a cutter blade.

FIG. 4 is an enlarged perspective view of the cutter blade installation jig 128. The installation jig comprises a rectangular mounting plate 129, which can be secured to the table top. The mounting plate 129 includes a recessed pattern 131 configured to receive closely therein the cutter blade assembly 17. The cutter blade assembly can be pulled from the needle chuck by overcoming the spring force of the ball and detent means. The recessed pattern 131 includes a work surface 132 upon which the cutter blade holding plate 54 rests when the cutter blade assembly 17 is mounted on its side into the recess. With the cutter blade assembly 17 turned sideways and mounted into the recess 131 of the base plate 129, the cutter blade 61 can be installed or replaced if necessary by an operator. The work surface 132 includes a line 133 for checking the angle of the cutting edge of the cutter blade 61. In addition, the base plate 129 includes a spare knife pocket 134 for housing additional replacement cutter blades.

Figure 5:
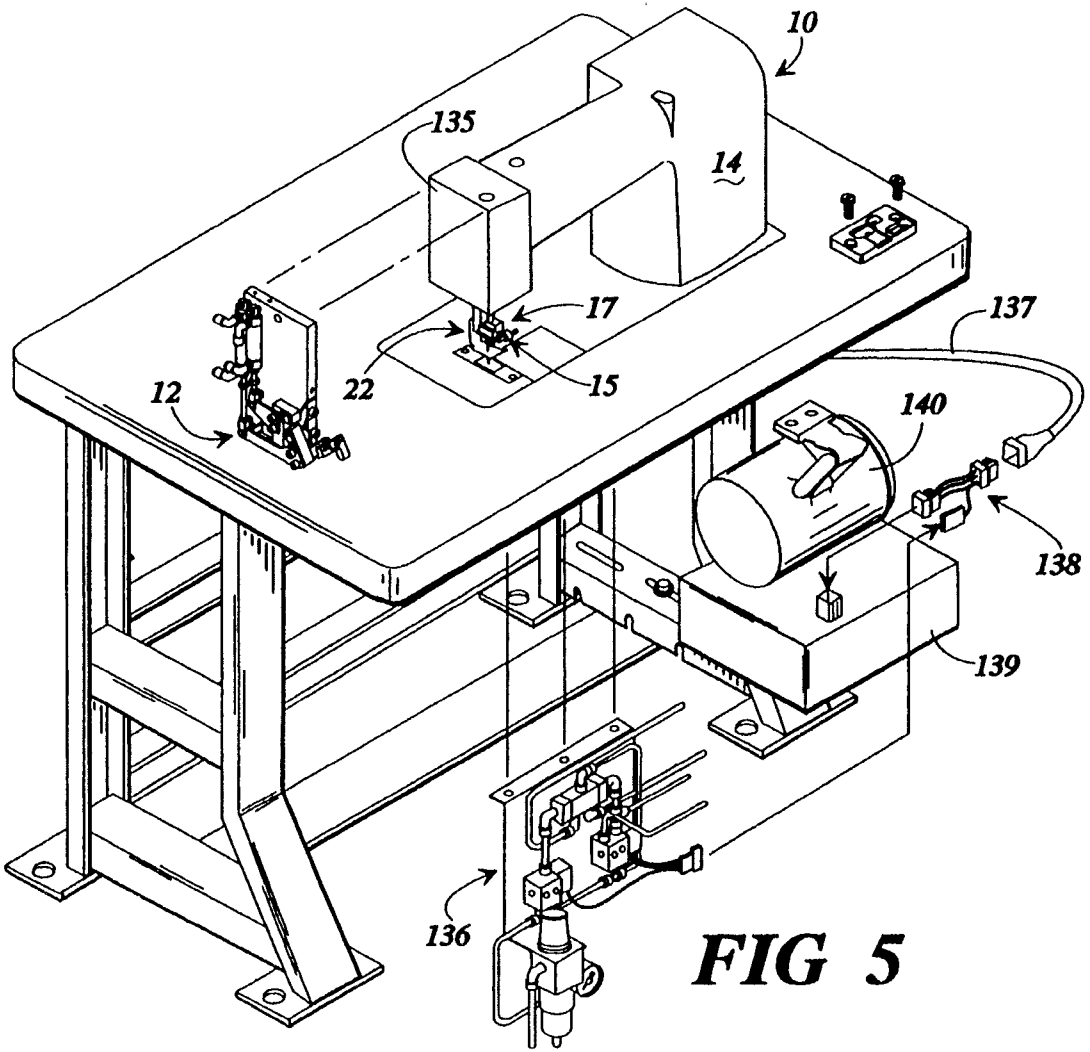
FIG. 5 is a partially exploded perspective view of the cloth cutter attachment shown in FIG. 1 and the sewing machine illustrating the actuator means control connection with the sewing machine controls.

FIG. 5 is a perspective view of the entire sewing machine 10, part of which is shown in FIG. 1. The cloth cutter attachment 12 is designed to mount on the side face 135 of the housing frame 14 of the sewing machine 10. The needle mount assembly 15 and the cutter blade assembly 17 are mounted to the needle bar. The cloth cutter attachment is also provided with a control assembly 136 that is adapted to receive compressed air from a pneumatic air source and control the operation of the front and rear air cylinders 121, 122 in response to control signals from the sewing machine controls. The control assembly 136 comprises a solenoid control pneumatic assembly that is conventional and well known in the art. A solenoid adapter cable 138 is provided to plug into the sewing machine control cable 137 leading to the control box 139 for the sewing machine motor 140. Also shown in FIG. 5 is a preferred mounting location for the installation jig 128.

Figure 8A:
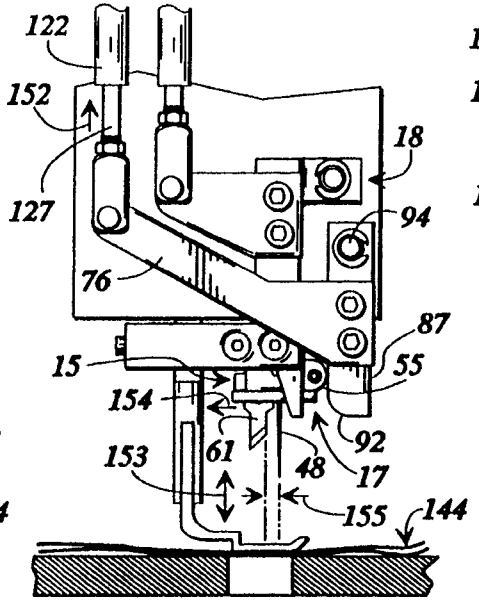
Figure 8B:
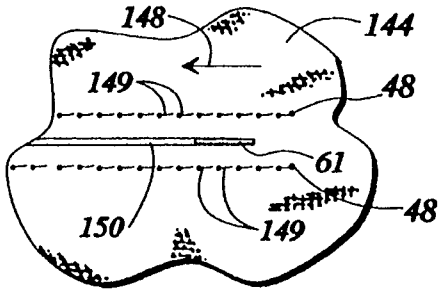
Figure 7A:
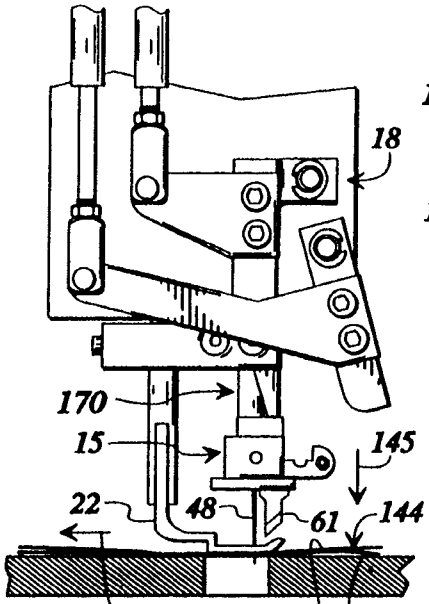
Figure 7B:
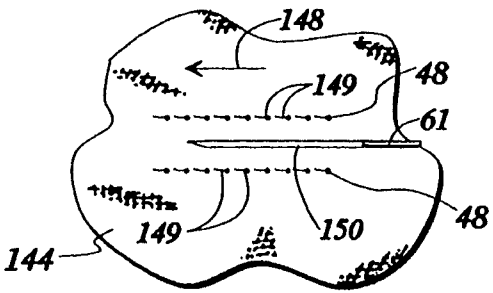
Figure 6:
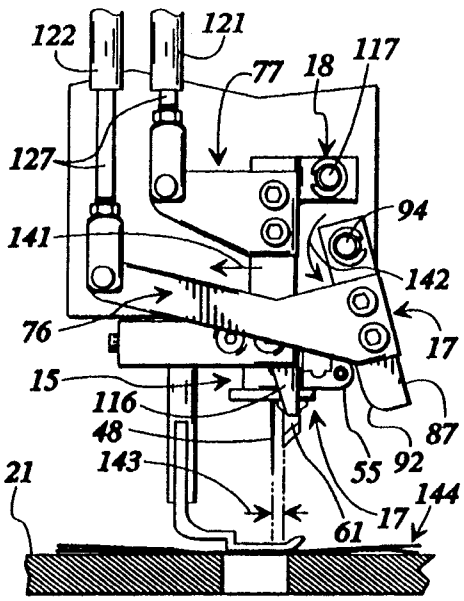

FIGS. 6, 7A, 8A and 9 are side elevation views of the cloth cutter attachment 12 illustrating the sequence of movements of the needle chuck 32, the cutter blade assembly 17 and the actuator means 18. FIGS. 7B and 8B are diagrammatic views of the stitches and cuts made in the cloth work piece which correspond to the positions of cutter blade 61 as shown in FIGS. 7A and 8A, respectively. As shown in FIG. 6, prior to the start of the stitch and cut operation, the piston rod 127 extending from the front air cylinder 121 is retracted to pivot the advancing linkage 77 backwards, as indicated by arrow 141, so that the prongs 116 depending from the advancing linkage 77 are in their aft or rearward most position. The piston rod 127 extending from the rear air cylinder 122 is fully extended, which causes the cam lever 87 to pivot counter-clockwise, as indicated by arrow 142.

In this position, the cam surface 92 of the cam lever 87 is positioned outward ahead of the head 55 of the cutter blade assembly 17. The cutter blade assembly 17 is extended from the needle mount assembly 15 as a result of the cutter blade advancing step of a prior stitch operation. The cutter blade assembly 17 is held in this extended position by the engagement of the ball of the ball detent means 43 with the detents in the slide bar. Thus, it should be seen that the ball and detents function as a stop-means for holding the cutter blade assembly. With the cutter blade assembly 17 extended forward, the cutter blade 61 is positioned ahead of the sewing needles 48, as indicated by arrow 143. So arranged, the stitch and cut operation for forming a set-in pocket is ready to commence.

FIG. 7A illustrates the movement of the sewing needles and the cutter blade 61 toward the cloth material 144, as indicated by arrow 145. The cloth material 144 comprises a garment piece 146 and an overlying pocket piece 147. The two pieces of material are held between the presser foot assembly 22 and the feed dog mounted underneath the working surface 21 of the sewing machine and are advanced in the direction indicated by arrow 148. FIG. 7A is the only figure that shows the needle bar 170 to which the needle mount assembly 15 is secured. As shown in FIG. 7B, the cloth material 144 is advanced in the direction of arrow 148, and the stitches 149 are sewn behind the cuts 150 made in the material by the cutter blade 61, which leads the sewing needles 48.

In FIG. 8A, the piston rod 127 of the rear air cylinder 122 has been retracted upwards, as indicated by arrow 152, thereby pivoting the cam lever 87 about pivot pin 94. The pivoting of cam lever 87 causes the cam surface 92 to engage the head 55 of the cutter blade assembly 17. The cam surface 92 engages the cutter blade assembly 17 as the needle mount assembly 15 reciprocates up and down, as indicated by arrow 153. As the cutter blade 17 assembly is retracted rearwardly, as indicated by arrow 154, the cutter blade 61 moves between and behind the sewing needles 48 to a position spaced from the sewing needles, as indicated by arrow 155. The ball and detent means secures the cutter blade assembly in this aft position. The needles 48 stitch the cloth material 144 ahead of the cuts 150 that the cutter blade 61 makes in the material 144, as shown in FIG. 8B. The distances 143, 155 of the cutter blade 61 in front of and behind the sewing needles 48 is determined by the locations of and the distance between the detents 59 and other design features of the cutter blade assembly 17 and the actuator means 18 and can be any desired distance suitable for a particular application.

Figure 9:
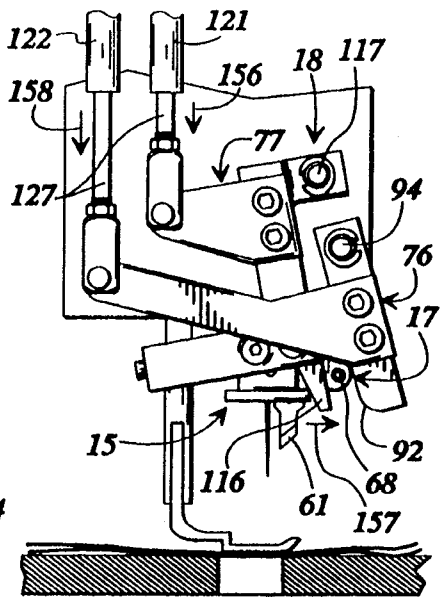
FIGS. 6–9 are a sequence of side elevation views and diagrammatic views of the cloth cutter attachment shown in FIG. 1 illustrating the sequential movement of the cutter blade assembly, the sewing needles, the needle mount assembly, and the actuator means, and also illustrating the stitch and cut pattern made in the cloth work piece.

FIG. 9 illustrates the positioning of the cloth cutter attachment at the end of the stitch and cut operation. After the stitch and cut is complete, the needle mount assembly 15 is raised and the cutter blade 61 is advanced forward ahead of the sewing needles, into position to commence subsequent stitch and cut operations. To advance the cutter blade assembly 17 forward, the piston rod 127 of the front air cylinder 121 is extended, as indicated by arrow 156, causing the advancing linkage 77 to pivot about pivot pin 117. Upon pivoting of the advancing linkage 77, the prongs 116 depending from the advancing linkage 77 pivot forward as they straddle the cutter blade assembly 17 and engage the spring pin 68 in the cutter blade assembly, causing the cutter blade assembly 17 to shift forward, as indicated by arrow 157. The piston rod 127 of the rear air cylinder 122 is also extended, in the direction indicated by arrow 158, thereby pivoting the retracting linkage 76, which positions the cam surface 92 of the cam lever forward ahead of the cutter blade assembly 17.

It should be noted that the retracting linkage 76 is released from engagement with the cutter blade assembly as the ball and detent means secures the cutter blade assembly in its rearward position. In this manner, the cam surface 92 of the cam lever 87 does not remain continuously in contact with the head 55 of the cutter blade assembly, but rather intermittently engages the head 55 to shift the cutter blade assembly. As a result, wear and tear between the cam lever and the cutter blade assembly is minimal and vibration is reduced.

Figure 10:
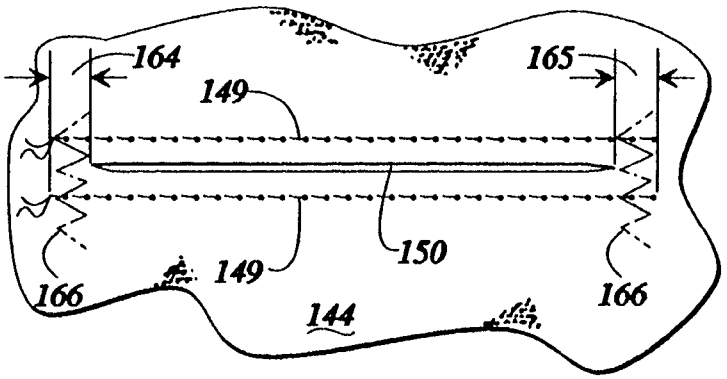
FIG. 10 is an enlarged detailed view of a cloth work piece having been stitched and cut by the sewing machine and the cloth cutter attachment shown in FIG. 1.

FIG. 10 is an enlarged detailed view of the final stitch and cut pattern in the cloth material 144. Two spaced rows of stitches 149 are formed by the pair of sewing needles 48, and the cut 150 is made down between the two stitches 149. The off-set distances 164, 165 between the ends of the lines of stitches 149 and the ends of the cut line 150 correspond to the distances 143, 155, respectively, that the cutter blade moves ahead of and behind the sewing needles. The off-set distances 164, 165 provide a transverse stitch area in the cloth material 144 for a bar tack 166 to be made perpendicular to the lines of stitches 149. With the ends of the stitch and cut pattern bar tacked, the cut line 150 is completely enclosed by stitching and the cloth material can subsequently be processed to finish the completed set-in pocket.

While the cloth cutter attachment of the present invention has been described herein in conjunction with a pair of sewing needles, it will be understood by those skilled in the art that the cutter blade assembly and the actuator means of the present invention can operate in conjunction with a single needle mounted to the needle mount assembly to produce, if desired, a single stitch and cut. Such an arrangement would also reduce vibration and increase the precision of the cutting operation.

The features and principles of the present invention have been illustrated in the foregoing description of a preferred embodiment thereof. It will be apparent to those skilled in the art that various changes or modifications may be made thereto without departure from the spirit and scope of the invention as set forth in the following claims.

We claim:

1. A cloth cutter attachment for a double needle sewing machine of the type including a housing frame, means for advancing cloth along a stitching path, a pair of laterally spaced sewing needles for sewing stitches in the cloth as the cloth is moved along the stitching path, and a reciprocatable needle bar for supporting the needles and the cloth cutter attachment, the cloth cutter attachment comprising:

a needle mount assembly for mounting to the sewing machine needle bar including a needle chuck for supporting a pair of sewing needles in spaced side-by-side parallel relationship laterally spaced across the stitching path for sewing parallel stitches in the cloth moved along the stitching path, a cutter blade assembly movably mounted to the needle chuck, said cutter blade assembly including a cutter blade aligned with the space between said sewing needles and with the stitching path and movable with said cutter blade assembly between said sewing needles to positions ahead of and behind said sewing needles along the stitching path for cutting the cloth to be sewn by said sewing needles, said cutter blade assembly including a cam follower means for moving said cutter blade;

cam actuator means for mounting to the sewing machine housing frame, including a cutter blade retracting linkage for engaging said cam follower and shifting the cutter blade assembly behind the sewing needles and a cutter blade advancing linkage for engaging said cam follower and shifting the cutter blade assembly ahead of the sewing needles, and both said linkages being selectively intermittently engageable with and movable away from the cutter blade assembly, said needle chuck and said cutter blade assembly including stop means for releasably maintaining said cutter blade alternatively in said forward position or in said rearward position without requiring engagement of said cam follower by said linkages, so that the cutter blade cuts the cloth ahead of the sewing needles with the cutter blade in said forward position, and as the sewing needles continue to stitch the cloth, the cutter blade is shifted by the actuator means to its position behind the sewing needles to said rearward position and is maintained in said rearward position by the stop means, so that the cutter blade cuts the cloth behind the sewing needles.

2. A cloth cutter attachment for a double needle sewing machine of the type including a housing frame, means for advancing cloth along a stitching path, a pair of laterally spaced sewing needles for sewing stitches along a stitching path in the cloth as the cloth is moved along the stitching path, and a reciprocatable needle bar for supporting the cloth cutter attachment, the cloth cutter attachment comprising:

a needle mount assembly for mounting to the sewing machine needle bar including a needle chuck for supporting the sewing needles, a cutter blade assembly movable mounted to the needle chuck, said cutter blade assembly including a cutter blade aligned with the stitching path and movable with said cutter blade assembly between said sewing needles to positions ahead of and behind said sewing needles along the stitching path for cutting the cloth to be sewn by said sewing needles, actuator means for mounting to the sewing machine housing frame and selectively intermittently engageable with said cutter blade assembly for shifting said cutter blade longitudinally along the stitching path between a forward position ahead of the sewing needles and a rearward position behind the sewing needles, said cutter blade assembly including an elongated cross bar extending transverse to the direction of the shifting movement of the cutter blade assembly, said actuator means including a pair of prongs which straddle the cutter blade assembly, for engaging the cross bar to shift the cutter blade assembly to said forward position.

3. A cloth cutter attachment for mounting to a sewing machine of the type including a sewing machine housing frame, means for advancing cloth along a stitching path, and a reciprocatable needle bar for supporting the cloth cutter attachment at the sewing path, the cloth cutter attachment comprising:

a needle mount assembly for mounting to the sewing machine needle bar and including at least one sewing needle and a needle chuck for mounting to the needle bar of the sewing machine and supporting the sewing needle, the needle mount assembly adapted to sew a stitch along a stitching path in the cloth, a cutter blade assembly movably mounted to the needle chuck, the cutter blade assembly including a cutter blade aligned parallel to the stitching path adjacent the sewing needle for cutting the cloth and movable between positions ahead of and behind the sewing needle, actuator means for mounting to the sewing machine housing frame including a cutter blade retracting linkage for shifting said cutter blade to a position rearwardly behind the sewing needle, and a cutter blade advancing linkage for shifting said cutter blade to a position forwardly of the sewing needle, and air cylinders for actuating said retracting and advancing linkages, said needle chuck and said cutter blade assembly including stop means for releasably maintaining said cutter blade alternately in said forward position or in said rearward position without engagement by said actuator means, so that as the sewing needle begins stitching the cloth with the cutter blade in its forward position, the cutter blade cuts the cloth ahead of the sewing needle, and as the sewing needle continues to stitch the cloth, the cutter blade is shifted by the actuator means to its position behind the sewing needle to said rearward position and is maintained in the rearward position by the stop means, so that the cutter blade cuts the cloth behind the sewing needle.

4. A method for stitching and cutting a pair of overlying pieces of material in order to form a sewn stitch in the materials with a cut through the materials adjacent the sewn stitch, and with the cut shorter in length than the sewn stitch and centered longitudinally with respect to the sewn stitch, the method comprising the steps of:

advancing the overlying pieces of material on a sewing machine work surface past a sewing needle and a cutter blade assembly positioned adjacent and ahead of the sewing needle, with the cutter blade assembly slidably mounted on a needle chuck which supports the sewing needle, reciprocating the needle and the cutter blade of the cutter blade assembly into and out of the pieces of material as the pieces of material are advanced so that the stitch and a cut is made through the pieces of material with the leading edge of the cut starting ahead of the leading edge of the stitch, after the step of reciprocating the needle and the cutter blade has commenced, intermittently engaging the cutter blade assembly with cam means mounted on the sewing machine frame only as the reciprocating needle and cutter blade have moved away from the material to shift the cutter blade behind the sewing needle, so that the stitch is made ahead of the cut, after the cutter blade has been shifted, withdrawing the cam means from the cutter blade assembly, and maintaining said cutter blade ahead of the sewing needle.

* * * * *